US010360861B2

(12) United States Patent
Dunn et al.

(10) Patent No.: US 10,360,861 B2
(45) Date of Patent: Jul. 23, 2019

(54) REDUNDANT POWER/CONTROL SYSTEM FOR ELECTRONIC DISPLAYS

(71) Applicant: American Panel Corporation, Alpharetta, GA (US)

(72) Inventors: William Dunn, Alpharetta, GA (US); Ken Mahdi, Alpharetta, GA (US)

( * ) Notice: Subject to any disclaimer, the term of this patent is extended or adjusted under 35 U.S.C. 154(b) by 0 days.

(21) Appl. No.: 15/974,738

(22) Filed: May 9, 2018

(65) Prior Publication Data

US 2018/0261173 A1 Sep. 13, 2018

Related U.S. Application Data

(63) Continuation of application No. 15/599,618, filed on May 19, 2017, now Pat. No. 9,997,118, which is a continuation of application No. 14/833,786, filed on Aug. 24, 2015, now Pat. No. 9,666,148, which is a continuation of application No. 14/258,347, filed on Apr. 22, 2014, now Pat. No. 9,117,417, which is a continuation of application No. 13/080,354, filed on Apr. 5, 2011, now Pat. No. 8,704,751.

(60) Provisional application No. 61/321,084, filed on Apr. 5, 2010.

(51) Int. Cl.
*G09G 3/36* (2006.01)
*G09G 3/34* (2006.01)

(52) U.S. Cl.
CPC ..... *G09G 3/3611* (2013.01); *G09G 3/3406* (2013.01); *G09G 3/3607* (2013.01); *G09G 3/3648* (2013.01); *G09G 2310/0237* (2013.01); *G09G 2320/041* (2013.01); *G09G 2320/08* (2013.01); *G09G 2330/08* (2013.01); *G09G 2360/14* (2013.01)

(58) Field of Classification Search
None
See application file for complete search history.

(56) References Cited

U.S. PATENT DOCUMENTS

| | | | | |
|---|---|---|---|---|
| 6,099,145 | A | 8/2000 | Sendova et al. | |
| 6,388,658 | B1 * | 5/2002 | Ahern | G06F 13/4022 345/1.1 |
| 7,012,382 | B2 | 3/2006 | Cheang et al. | |
| 7,293,907 | B2 | 11/2007 | Kim et al. | |
| 7,465,079 | B1 | 12/2008 | Cull et al. | |
| 7,502,950 | B1 | 3/2009 | Brands | |
| 8,704,751 | B2 | 4/2014 | Dunn et al. | |
| 9,117,417 | B2 | 8/2015 | Dunn et al. | |
| 9,666,148 | B2 | 5/2017 | Dunn et al. | |
| 2005/0242742 | A1 | 11/2005 | Cheang et al. | |
| 2008/0024480 | A1 | 1/2008 | Jee et al. | |
| 2008/0045275 | A1 | 2/2008 | Le | |

(Continued)

*Primary Examiner* — Kenneth B Lee, Jr.
(74) *Attorney, Agent, or Firm* — Standley Law Group LLP; Jeffrey S. Standley; Adam J. Smith

(57) ABSTRACT

An electronic display assembly includes a first and second power source. A first power supply monitor is in electrical connection with the first power source and the electronic display and a second power supply monitor is in electrical connection with the second power source and the electronic display. An electronic display controller accepts control signals and is in electrical communication with the first and second power supply monitors. A multiplexer is in electrical connection with the first and second power supply monitors, the electronic display controller, and the electronic display.

20 Claims, 3 Drawing Sheets

(56) References Cited

U.S. PATENT DOCUMENTS

| | | | |
|---|---|---|---|
| 2008/0068293 | A1 | 3/2008 | Ishii |
| 2009/0153464 | A1 | 6/2009 | Furukawa et al. |
| 2009/0273764 | A1 | 11/2009 | D'Alessio et al. |

* cited by examiner

REDUNDANT POWER/CONTROL SYSTEM FOR ELECTRONIC DISPLAYS

CROSS-REFERENCE TO RELATED APPLICATIONS

This application is a continuation of U.S. application Ser. No. 15/599,618 filed on May 19, 2017, which is a continuation of U.S. application Ser. No. 14/833,786 filed on Aug. 24, 2015, now U.S. Pat. No. 9,666,148 issued on May 30, 2017, which is a continuation of U.S. application Ser. No. 14/258,347 filed on Apr. 22, 2014, now U.S. Pat. No. 9,117,417 issued on Aug. 25, 2015, which is a continuation of U.S. application Ser. No. 13/080,354 filed on Apr. 5, 2011, now U.S. Pat. No. 8,704,751 issued on Apr. 22, 2014, which is a non-provisional application of U.S. Application No. 61/321,084 filed on Apr. 5, 2010. All aforementioned applications are hereby incorporated by reference in their entirety as if fully cited herein.

TECHNICAL FIELD

Disclosed embodiments relate generally to a redundant control system architecture for a liquid crystal display device.

BACKGROUND OF THE ART

Liquid Crystal Displays (LCDs) contain several layers which work in combination to create a viewable image. A backlight is used to generate the rays of light that pass through what is commonly referred to as the LCD stack, which typically contains several layers that perform either basic or enhanced functions. The most fundamental layer within the LCD stack is the liquid crystal material, which may be actively configured in response to an applied voltage/charge in order to pass or block a certain amount of light which is originating from the backlight. The layer of liquid crystal material is divided into many small regions which are typically referred to as pixels. For full-color displays these pixels are further divided into independently-controllable regions of red, green and blue subpixels, where the red subpixel has a red color filter, blue subpixel has a blue color filter, and green subpixel has a green color filter.

The light which is passing through each subpixel typically originates as "white" (or broadband) light from the backlight, although in general this light is far from being uniform across the visible spectrum. The subpixel color filters allow each subpixel to transmit a certain amount of each color (red, green or blue). When viewed from a distance, the three subpixels appear as one composite pixel and by electrically controlling the amount of light which passes through each subpixel, the composite pixel can produce a very wide range of different colors due to the effective mixing of light from the red, green, and blue subpixels.

Currently, the common and preferable illumination source for LCD backlight assemblies is light emitting diodes (LEDs). Environmental concerns, small space requirements, lower energy consumption, and long lifetime are some of the reasons that the LCD industry is beginning the widespread usage of LEDs for backlights.

LCDs are becoming popular for not only home entertainment purposes, but are now being used as informational/advertising displays in both indoor and outdoor locations. When used for information/advertising purposes, the displays may remain 'on' for extended periods of time and thus would see much more use than a traditional home theatre use. Further, when displays are used in areas where the ambient light level is fairly high (especially outdoors or in aircraft cockpits) the displays must be very bright in order to maintain adequate picture brightness. When used for extended periods of time and/or outdoors, durability of the components can become an issue.

Modern LCD devices have become more sophisticated and now use a plurality of sensors and logic to maintain optimal performance. As is readily apparent, an LCD will not function satisfactorily without an appropriate and properly-functioning control system. The backlight is also essential for proper functioning as the image or data displayed on the liquid crystal layer may only be viewed while the backlight is providing proper illumination to the liquid crystal stack. If the backlight system should fail completely or operate at a less than optimal level, then the LCD will not perform satisfactorily. While this may be a simple inconvenience when LCDs are used for entertainment purposes, when used for information or data displays this can be very costly. For example, LCDs are now being used in aircraft cockpits as well as the instrument panels or display(s) in ground vehicles and marine equipment. In these applications, when there is a failure within the control system, the LCD may no longer display the important information for the vehicle/aircraft and controls may cease to operate. These situations can be undesirable not only to the passengers of the vehicle/aircraft, but also other soldiers/team members who are counting on this part of the mission.

Some control systems have a limited life span, and eventually their performance may suffer. Some systems may quickly fail simply due to a manufacturing defect or may fail due to shock/forces applied to the aircraft or ground vehicle. Currently when this occurs, the entire LCD device must be manually replaced. This is expensive, and is often time consuming. Alternatively, the LCD device could be removed from the display housing, and the degraded or faulty system elements could be manually replaced. This is typically even more costly, and involves extensive manual labor. In currently known units, this also requires virtual complete disassembly of the LCD to gain access to the electronics. This complete disassembly is not only labor intensive, but must be performed in a clean room environment and involves the handling of expensive, delicate, and fragile components that can be easily damaged or destroyed, even with the use of expensive specialized tools, equipment, fixtures, and facilities.

Thus, there exists a need for a more durable and dependable control system for an LCD so that failures can be accounted for and vehicles/aircraft can complete a mission and/or return safely to base.

SUMMARY

Exemplary embodiments provide a power and control system for an LCD device where redundancy is used to create a system that is robust and can continue operations even upon a failure in the control system, power module, sensors, or other electronic assembly within.

Arbiter logic is used to constantly monitor any deviation in operating power supplies or logic control signals. The preferred embodiments provide two independent paths for signals and power to flow to the LCD and LED backlight thereby any failure or deviation in these signals that prevents the display from working properly can be eliminated.

DETAILED DESCRIPTION

Figure 1:
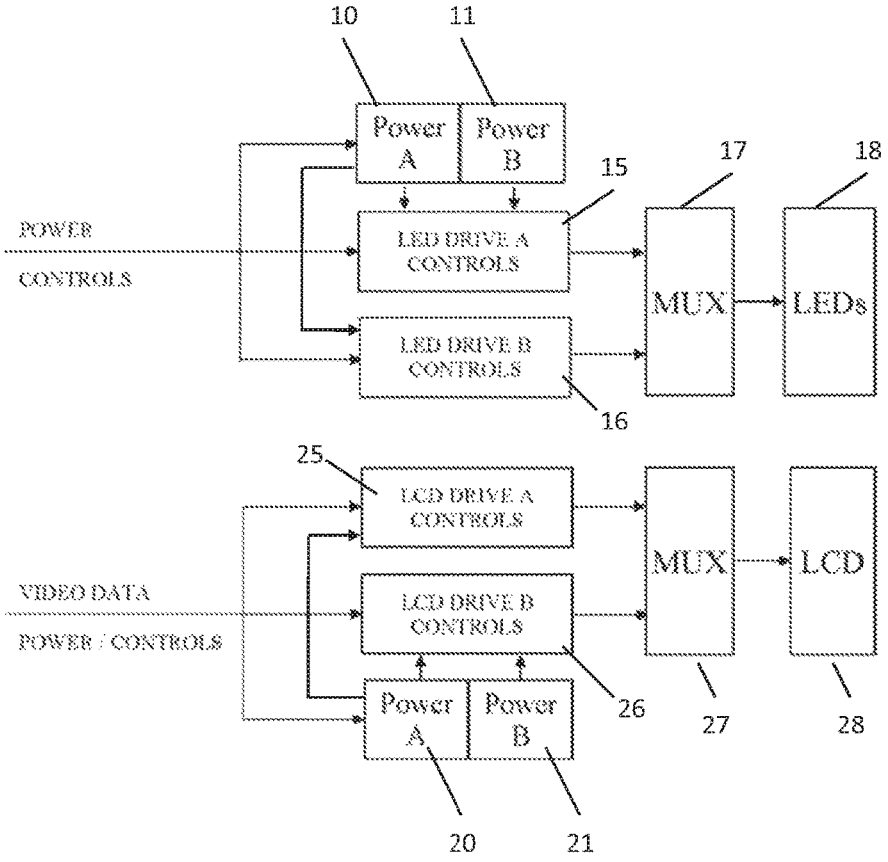
FIG. 1 shows an electrical block diagram of an embodiment for the overall system architecture of a redundant power/control system.

FIG. 1 shows an electrical block diagram of an embodiment for the overall system architecture of a redundant power/control system. In this embodiment, there are dual redundant paths of required DC power and associated control signals for the LCD 28 and the LED backlight 18. For the backlight section of this embodiment, two independent power supplies 10 and 11 may provide power to the LED controls and drive circuitry. There may be two independent circuits 15 and 16 for driving and controlling the LEDs. The back-end circuitry and components may provide the control signals and power for the LED drive controls 15 and 16 as well as the power supplies 10 and 11.

For the LCD section of this embodiment, two independent power supplies 20 and 21 may provide power to the LCD controls 28 and drive circuitry 27. There are two independent circuits 25 and 26 for driving and controlling the LCD. The back-end circuitry and components may provide the source controls/power and video data for the LCD drive controls 25 and 26 as well as the power supplies 20 and 21.

The two independent paths for the LED backlight 18 and LCD 28 are multiplexed (see MUX 17 and 27 respectively) to provide one set of inputs to the LEDs 18 and LCD 28. The control signals to the multiplexers 17 and 27 may be provided through Arbiter logic which may be constantly monitoring any deviation in operating power supplies or logic control signals. This scheme provides two independent paths for signals and power to flow to the LCD 28 and LEDs 18 such that any failure or deviation in one path allows the assembly to switch to the alternative path.

It should be noted that the diagram in FIG. 1 is simplified to simply provide an outline of the overall system architecture. Additional details on the LCD controls and the LED backlight controls are provided in FIGS. 2 and 3 respectively.

Figure 2:
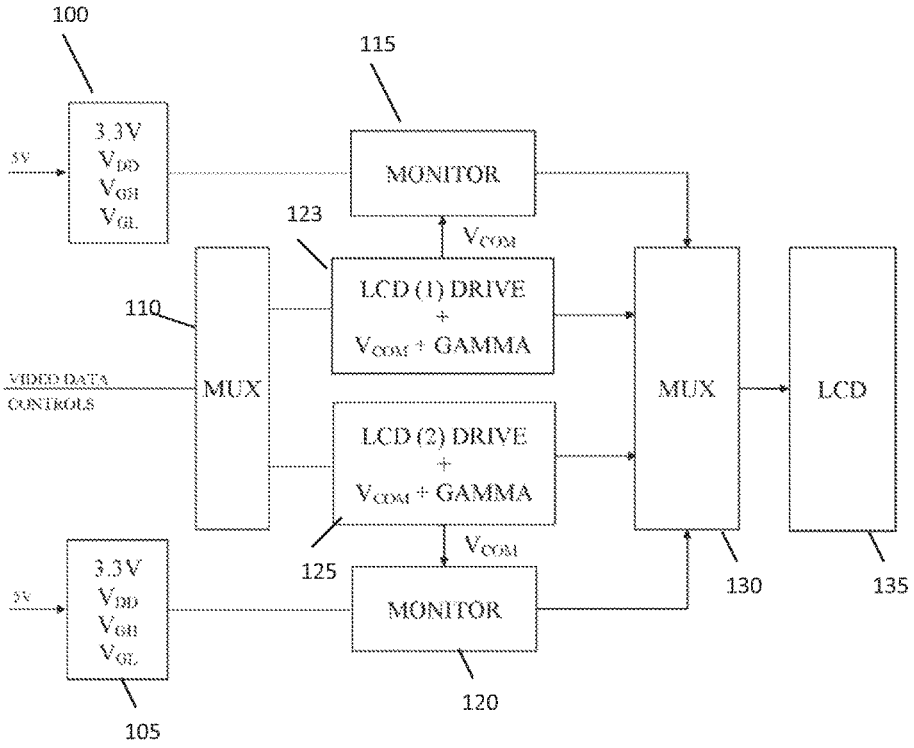
FIG. 2 shows an electrical block diagram of an embodiment for a redundant LCD power/control system.

FIG. 2 shows an electrical block diagram of an embodiment for a redundant LCD power/control system. This embodiment provides two independent paths for video data, controls, and power to the LCD. Two sets of power supplies 100 and 105 may be used to generate the LCD power (for example 3.3V, $V_{DD}$, $V_{GH}$, and $V_{GL}$). The power supplies 100 and 105 are monitored continuously by monitoring circuitry 115 and 120 respectively for any deviation or loss. Arbitration logic may be used to select the appropriate set for the associated LCD drive and gamma control. In addition, there are two sets of LCD control circuits (drive, Worn, and Gamma generation circuits) 123 and 125 that are monitored continuously. The arbitration logic may be used to select the appropriate set to be channeled to the LCD 135 via the multiplex logic contained within the multiplexer 130. The video data may also be multiplexed and channeled appropriately by a multiplexer 110 prior to being sent to the circuits 123 and 125.

It should be noted that although two separate monitoring circuits 115 and 120 are shown, some embodiments may combine these into a single circuit for monitoring the electrical communication from the power supplies 100 and 105 as well as the communications from the LCD control circuits 123 and 125.

Figure 3:
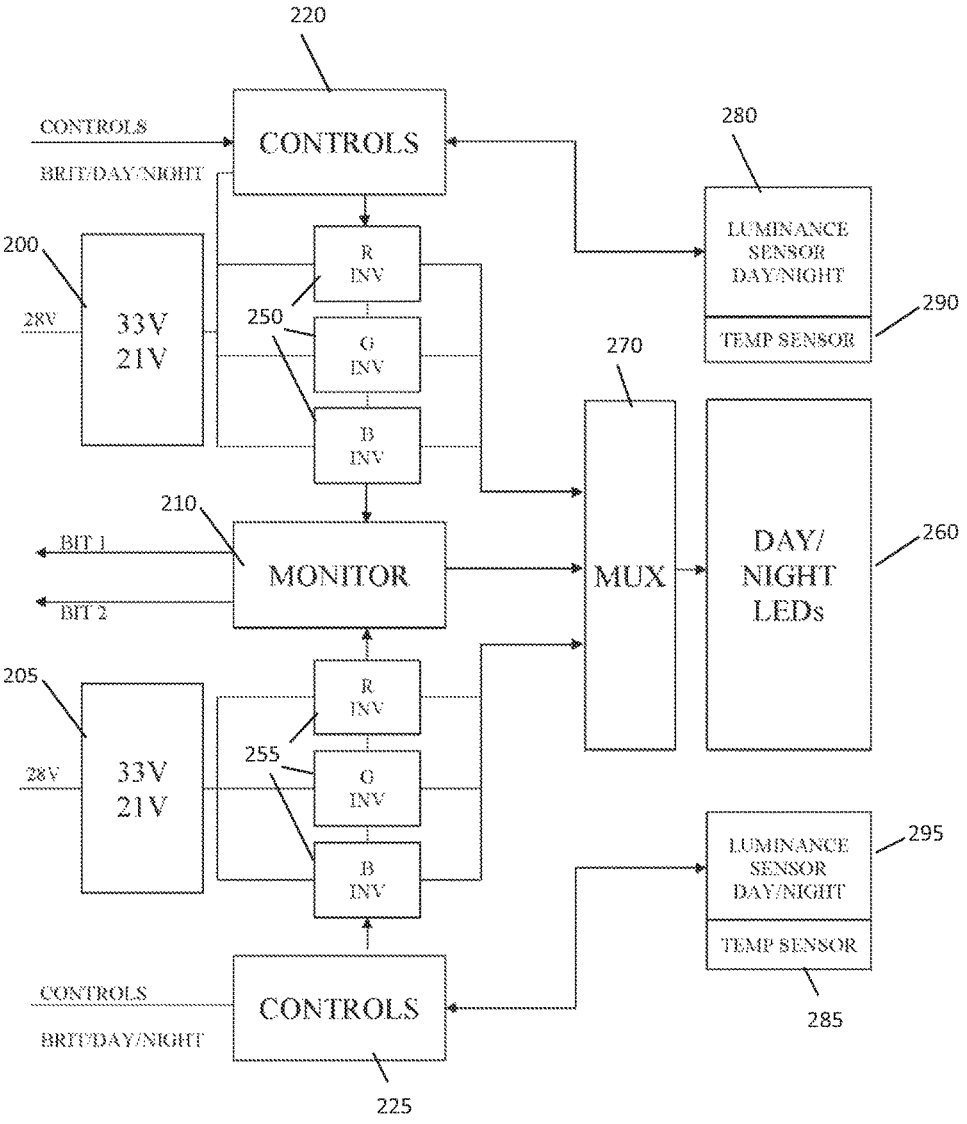
FIG. 3 shows an electrical block diagram of an embodiment for a redundant backlight power/control system.

FIG. 3 shows an electrical block diagram of an embodiment for a redundant backlight power/control system. A first power supply 200 is in electrical communication with a power inverter 250 while a second power supply 205 is in electrical communication with a second power inverter 255. Both power inverters 250 and 255 are in electrical communication with monitoring circuitry 210 which continuously analyzes the signals coming from the power inverters 250 and 255 to determine if one or more components have failed or started to malfunction. The monitoring circuitry 210 may determine if the signal has unexpected deviations or stops altogether and may switch from one set of power supply/power inverter/control circuit to the other. This switch can take place in a matter of milliseconds, providing little to no interruption of the display performance.

The controlling signals for the LED backlight are sent to a first control circuit 220 which also accepts input from a first temperature sensor 290 and first luminance sensor 280. Accordingly, the controlling signals for the LED backlight are also sent to a second control circuit 225 which also accepts input from a second temperature sensor 285 and second luminance sensor 295. The output signals from the power inverters 250 and 255 as well as the output signal from the monitoring circuitry 210 may be multiplexed with multiplexer 270, and then sent to the LEDs 260.

It should be noted that in embodiments used for night operations, there may actually be two sets of LEDs (one for daytime and one for nighttime operations). This is certainly not required but this embodiment can be used if both daytime and nighttime LEDs are being used.

It should also be mentioned that although shown as a RGB setup, there are many methods for generating white light for the backlight and any method could be used with the embodiments herein. Some embodiments may use several colored LEDs in any combination to create the color white. Sometimes this may be done with a pair of LEDs consisting of a red-green and a red-blue LED that combine to create white. Some embodiments may only use white LEDs for the backlight.

As shown herein, the overall system architecture shown in FIG. 1 may use the LCD control system shown in FIG. 2 or may use other designs. Similarly, the overall system architecture shown in FIG. 1 may use the backlight control system shown in FIG. 3 or may use other designs. It should also be noted that the voltages shown in the Figures are only for illustration and should not be used to limit the exemplary embodiments to such voltages.

Having shown and described preferred embodiments of the invention, those skilled in the art will realize that many variations and modifications may be made to affect the described embodiments and still be within the scope of the claimed invention. Additionally, many of the elements indicated above may be altered or replaced by different elements which will provide the same result and fall within the spirit of the exemplary embodiments. It is the intention, therefore, to limit the invention only as indicated by the scope of the claims.

What is claimed is:

1. An assembly for an electronic display comprising:

a first power source;

a second power source;

a first power supply monitor in electrical connection with the first power source and the electronic display;

a second power supply monitor in electrical connection with the second power source and the electronic display;

an electronic display controller accepting control signals and in electrical communication with the first and second power supply monitors; and a multiplexer in electrical connection with the first and second power supply monitors, the electronic display controller, and the electronic display.

2. The assembly of claim 1 wherein:

the electronic display controller comprises drive, Vcom, and Gamma generation circuits, each of which are monitored by the electronic display controller for signal deviation or loss.

3. The assembly of claim 1 wherein:

the electronic display controller comprises:

a first electronic display controller accepting the control signals and in electrical communication with the first power supply monitor and the multiplexer, and a second electronic display controller accepting the control signals and in electrical communication with the second power supply monitor and the multiplexer.

4. The assembly of claim 3 further comprising:

a second multiplexer accepting the control signals and distributing them to the first and second electronic display controllers.

5. The assembly of claim 1 wherein:

the first and second power supply monitors are adapted to monitor the first and second power sources, respectively, for a deviation or loss in power output.

6. The assembly of claim 5 wherein:

the first and second power supply monitors comprise logic which directs the multiplexer to utilize power output from either the first power source or the second power source to power the electronic display.

7. The assembly of claim 6 wherein:

the first and second power supply monitors are configured to detect a loss or deviation in power output received from the first or the second power sources and direct the multiplexer to utilize power output from the other power source upon the detection of such a loss or deviation.

8. The assembly of claim 1 wherein:

the electronic display is a liquid crystal type display.

9. The assembly of claim 8 wherein:

the electronic display comprises a backlight comprising a number of light emitting diodes.

10. An assembly for an electronic display comprising:

a first power supply;

a second power supply;

a backlight for the electronic display;

a first power supply controller in electrical connection with the first power supply and the backlight;

a second power supply controller in electrical connection with the second power supply and the backlight;

an electronic display monitor accepting control signals and in electrical communication with the first and second power supply controllers; and a multiplexer in electrical connection with the first and second power supply controllers, the backlight, and the monitor.

11. The assembly of claim 10 wherein:

the electronic display monitor comprises logic which directs the multiplexer to utilize either the first power supply or the second power supply to power the backlight.

12. The assembly of claim 11 wherein:

the logic is configured to determine a loss or deviation in power output from either of the first or the second power supplies and automatically switch to the remaining power supply upon the detection of such a deviation or loss.

13. The assembly of claim 10 wherein:

said first power supply controller and said second power supply controller are configured to accept signals representing a desired brightness of the backlight.

14. The assembly of claim 10 further comprising:

a first power inverter in electrical connection with the first power supply, the first power supply controller, and the electronic display monitor; and a second power inverter in electrical connection with the second power supply, the second power supply controller, and the electronic display monitor.

15. The assembly of claim 10 further comprising:

a first luminance sensor in electrical connection with the first power supply controller; and a second luminance sensor in electrical connection with the second power supply controller;

wherein the electronic display monitor is adapted to analyze the signals received from the first and second luminance sensors to determine if the power supply from the first or second power supplies has been interrupted.

16. The assembly of claim 15 further comprising:

a first temperature sensor in electrical connection with the first power supply controller; and a second temperature sensor in electrical connection with the power supply backlight controller;

wherein the electronic display monitor is adapted to analyze the signals received from the first and second temperature sensors to determine if the power supply from the first or second power supplies has been interrupted.

17. The assembly of claim 10 wherein:

the backlight comprises a number of light emitting diodes ("LEDs").

18. The assembly of claim 17 wherein:

the number of LEDs comprises a first number of daylight LEDs and a second number of nighttime LEDs.

19. The assembly of claim 10 wherein:

the electronic display is a liquid crystal type display.

20. An assembly for an electronic display comprising:

a first power source;

a second power source;

a backlight for said electronic display, wherein said electronic display is a liquid crystal display ("LCD");

a first power supply monitor in electrical connection with the first power source and the backlight;

a second power supply monitor in electrical connection with the second power source and the backlight;

a first multiplexer accepting control signals;

a first LCD control circuit in electrical connection with the first multiplexer and the first power supply monitor, wherein said first LCD control circuit receives the control signals;

a second LCD control circuit in electrical connection with the first multiplexer and the second power supply monitor, wherein said first LCD control circuit receives the control signals; and a second multiplexer in electrical connection with the first and second power supply monitors, the LCD control circuit, and the backlight, wherein said second multiplexer is configured to receive the control signals from the first and second LCD control circuit and the power supply from the first and second power supply monitors;

wherein first and second power supply monitors are configured to detect a deviation or loss in power output supplied from the first and second power sources, respectively;

wherein first and second power supply monitors comprise logic which directs the second multiplexer to automatically begin utilizing the remaining power supply and corresponding LCD control circuit upon detection of such a deviation or loss.

* * * * *